US008283874B2

(12) United States Patent
Buelow, II et al.

(10) Patent No.: US 8,283,874 B2
(45) Date of Patent: Oct. 9, 2012

(54) LED LIGHTING SYSTEM HAVING A REDUCED-POWER USAGE MODE

(75) Inventors: Roger F. Buelow, II, Gates Mills, OH (US); Gregory P. Frankiewicz, Mayfield Heights, OH (US); Laszlo A. Takacs, Lakewood, OH (US)

(73) Assignee: Energy Focus, Inc., Solon, OH (US)

( * ) Notice: Subject to any disclaimer, the term of this patent is extended or adjusted under 35 U.S.C. 154(b) by 310 days.

(21) Appl. No.: 12/489,193

(22) Filed: Jun. 22, 2009

(65) Prior Publication Data

US 2009/0322253 A1 Dec. 31, 2009

Related U.S. Application Data

(60) Provisional application No. 61/074,501, filed on Jun. 20, 2008.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 37/00* | (2006.01) |
| *H05B 39/00* | (2006.01) |
| *H05B 41/00* | (2006.01) |

(52) U.S. Cl. ..... 315/291; 315/312

(58) Field of Classification Search ..... None
See application file for complete search history.

(56) References Cited

U.S. PATENT DOCUMENTS

| | | | | |
|---|---|---|---|---|
| 2,844,762 | A | 7/1958 | Duryee | |
| 4,929,833 | A | 5/1990 | Smith | |
| 5,399,940 | A | 3/1995 | Hanna et al. | |
| 5,726,644 | A * | 3/1998 | Jednacz et al. | 340/9.14 |
| 6,744,223 | B2 * | 6/2004 | Laflamme et al. | 315/291 |
| 7,157,868 | B2 | 1/2007 | Brown et al. | |
| 2005/0237733 | A1 * | 10/2005 | Laski et al. | 362/147 |
| 2006/0170370 | A1 | 8/2006 | De Anna | |
| 2007/0228999 | A1 | 10/2007 | Kit | |
| 2008/0062687 | A1 * | 3/2008 | Behar et al. | 362/240 |

FOREIGN PATENT DOCUMENTS

KR 723912 B1 * 5/2007

OTHER PUBLICATIONS

U.S. Department of Energy Lighting Comparison Chart, Updated Feb. 9, 2011, [online], [retrieved on Jun. 10, 2011] Retrieved from the U.S. Department of Energy using Internet <http://www.energysavers.gov/your_home/lighting_daylighting/index.cfm/mytopic=12030>.*

(Continued)

*Primary Examiner* — Douglas W Owens
*Assistant Examiner* — Dedei K Hammond
(74) *Attorney, Agent, or Firm* — Charles E. Bruzga; Bruzga & Associates

(57) ABSTRACT

An LED lighting system, with first and second types of LEDs of different efficacies, has a reduced-power usage mode. A control system independently controls first and second control groups of first and second types of LEDs, respectively. The control system has one or more modes including a reduced-power usage mode for decreasing the overall power consumption of the lighting system while maintaining a light level of at least a predetermined percentage of the level present when the first control group of LEDs operates at a power level between less-than-full power and full power and the second control group is off. The predetermined percentage is 50. The control system decreases the overall power consumption of the lighting system in the reduced-power usage mode by turning off or dimming the first control group and turning on the second control group to at least some extent.

16 Claims, 5 Drawing Sheets

OTHER PUBLICATIONS

Diode, http://en.wikipedia.org/wiki/Diode (visited Jun. 22, 2009).
Color temperature, http://en.wikipedia.org/wiki/Color_temperature (visited Feb. 3, 2012).
Planckian locus, http://en.wikipedia.org/wiki/Planckian_locus (visited Feb. 7, 2012).
CIE 1931 color space, http://en.wikipedia.org/wiki/CIE_1931 (visited Feb. 7, 2012).
David Dilaura et al., The Lighting Handbook, Tenth Edition: Reference and Application, 2011, pp. 6.12-15, 6.18-19, 6.28-29, Illuminating Engineering Society, New York, NY.

* cited by examiner

LED LIGHTING SYSTEM HAVING A REDUCED-POWER USAGE MODE

FIELD OF THE INVENTION

The present invention relates to an LED lighting system, and more particularly to an LED lighting system having a reduced-power usage mode of operation.

BACKGROUND OF THE INVENTION

Rising costs of oil and electrical power are inducing the development of energy efficient systems and controls. Each year, mainly during the hot summer months, electric utilities in metropolitan areas face periods of peak power demand that can exceed the available power supply. The result can be rolling blackouts or brown-outs that can severely affect businesses, schools and basic operations within a city or across a large part of the country. The problem will only continue to grow worse as the need for electricity continues to grow faster than the ability to create new supplies.

One general concept to reduce the load on the power grid as well as reduce customer cost during these high demand, high cost periods, is to introduce a system of control known as demand response. The general concept is that during times of rising or peak demand, and therefore cost, the electric companies would send a signal to customers informing them that the price of electricity is rising or will rise. As used in the specifications, "signals" refer to any mode of communication. The customer can then respond by reducing their load on the power grid throughout their building to not only ease the burden on the power grid, but also to avoid paying the high cost of electricity on non-essential items.

The general concept can be as basic as a building owner receiving an email or phone call from the electric company and then physically walking around turning off lights and appliances in the building. The foregoing example obviously has drawbacks in that the electric power company is limited in its ability to contact customers and the customer also must be available to physically receive the signal and then roam throughout the building to power down appliances and systems.

An alternative solution that is emerging involves the customer setting up a network of appliances and machines that can be remotely controlled at a single access point for each room, zone or even for an entire building. The electric power company can send out a signal that will be received by a receiver set up by the customer. At this time, the customer will know a period of high demand is beginning and then, from each access point, can reduce the power load of each room, zone or building to avoid paying the high rates for electricity One of the main contributors to a building's electric use is the lighting system. Products are currently coming onto the market that allow lighting systems to be remotely turned on and off or even dimmed down various levels. Most of these products are either for compact fluorescent lamps (CFLs) or other fluorescent lamps, since halogens and incandescent lights are so inefficient that their use is becoming increasingly less common. Compact fluorescent lamps or other fluorescent lamps can be dimmed remotely to provide energy and cost savings. One problem with dimming these types of lamps is that, as they are dimmed down to save energy, their efficacy, i.e., lumens per watt, drops substantially. This severely limits the potential gains that can be realized with demand response dimming of compact fluorescent lamps or other fluorescent lamps.

However, the main problem with merely dimming lights is that there is a minimum level of lighting that must be maintained to provide a safe environment. The Illumination Engineering Society of North America and comparable organizations in other locations, have many guidelines that are generally used across the industry as the standard for how to light spaces. These guidelines set limits for various spaces, warehouses, schools, nursing homes, office buildings, etc, that balance safety, comfort, and production so that a space is adequately lit for a majority of its occupants. These guidelines only provide a minimum light level and the usual practice is to illuminate most spaces above the minimum levels required, to further improve safety, comfort, and work production.

Merely dimming light levels below a certain point to save energy not only affects comfort and productivity but poses a safety hazard. In fact, many insurance companies in the U.S. require signed contracts stating that a minimum light level will be maintained in a building. The reason is that exposure to liability can be large if the light level in work spaces drops below a certain level and an accident occurs. This is in addition to numerous studies which have proven that decreasing illumination below certain light levels has a negative effect on productivity. Accordingly, the present inventors have discerned that there Is a need to balance a reduction In energy usage with both the safety and productivity of the people in spaces being illuminated.

BRIEF SUMMARY OF THE INVENTION

One form of the invention provides an LED lighting system having a reduced-power usage mode, including first and second types of LEDs. The first type of LED has a substantially lower efficacy than the second type of LED by at least about 10 percent. At least 70 percent of the first type of LED are controllable together in a first control group of LEDs, and at least 70 percent of the second type of LED are controllable together in a second control group of LEDs. A control system independently controls the first and second control groups. The control system has one or more modes including a reduced-power usage mode for decreasing the overall power consumption of the lighting system while maintaining a light level of at least a predetermined percentage of the level present when the first control group of LEDs operates at a power level between less-than-full power and full power and the second control group is off. The predetermined percentage is 50. The control system decreases the overall power consumption of the lighting system in the reduced-power usage mode by turning off or dimming the first control group and turning on the second control group to at least some extent.

The foregoing lighting system advantageously balances a reduction in energy usage with both the safety and productivity of the people in spaces being illuminated.

BRIEF DESCRIPTION OF THE DRAWINGS

In the drawings, in which like reference numerals refer to like parts.

DETAILED DESCRIPTION OF THE INVENTION

This description first considers general principles of the invention, and then elaborates on specific embodiments and other modes of using the LED lighting system of the invention.

General Principles

The performance of Light-Emitting Diodes (LEDs) is reaching a level such that they are now being used for general illumination tasks. The U.S. Department of Energy predicts that in the next few years the efficacy of such devices will far surpass the most efficient light sources available today. Therefore it would be desirable to incorporate LEDs into a lighting system that can operate in a reduced-power usage mode, such as a demand-response mode.

Current commercially available LEDs can achieve source efficacies of 100 lumens per watt (LpW) for devices with a correlated color temperature (CCT) in the cool white range generally 4500 K and above. Such LEDs are referred to herein as cool white LEDs. Because of losses related to phosphor technology and the Stokes shift, warm white LEDs, with a correlated color temperature (CCT) generally at or below 3500 K produce less light, usually around 6—as opposed to 100 lumens per watt. However, most end users prefer a warm color temperature of 3000 K and lower, to mimic the light output from a traditional halogen or incandescent lamp.

Preferably, the first type 12 of LED provides a substantially warmer color temperature than the second type 14 of LED by a color temperature difference of at least about 500 K. Preferably, the color temperature of the first type 12 of LED is between about 2500 K and about 6500 K, and the color temperature of the second type of LED is between about 3000 K and 7000 K.

In this specification, by warm white LED is meant an LED with a significantly warmer CCT than a cool white LED, and vice-versa. As such, "warm white" and "cool white" are used herein as relative terms, whereby "warm white", for instance, may not refer exactly to a lamp designated as "warm white" by another entity.

The difference between warm white and cool white LEDs creates design tradeoffs. In order to achieve a highly efficient LED lighting system, cool white LEDs must be used, but light of this color temperature is not desirable or preferred by the end-user. However, using warm white LEDs requires a higher power system, which costs more to operate and is more susceptible to the high cost-peak energy problems described above.

Figure 1:
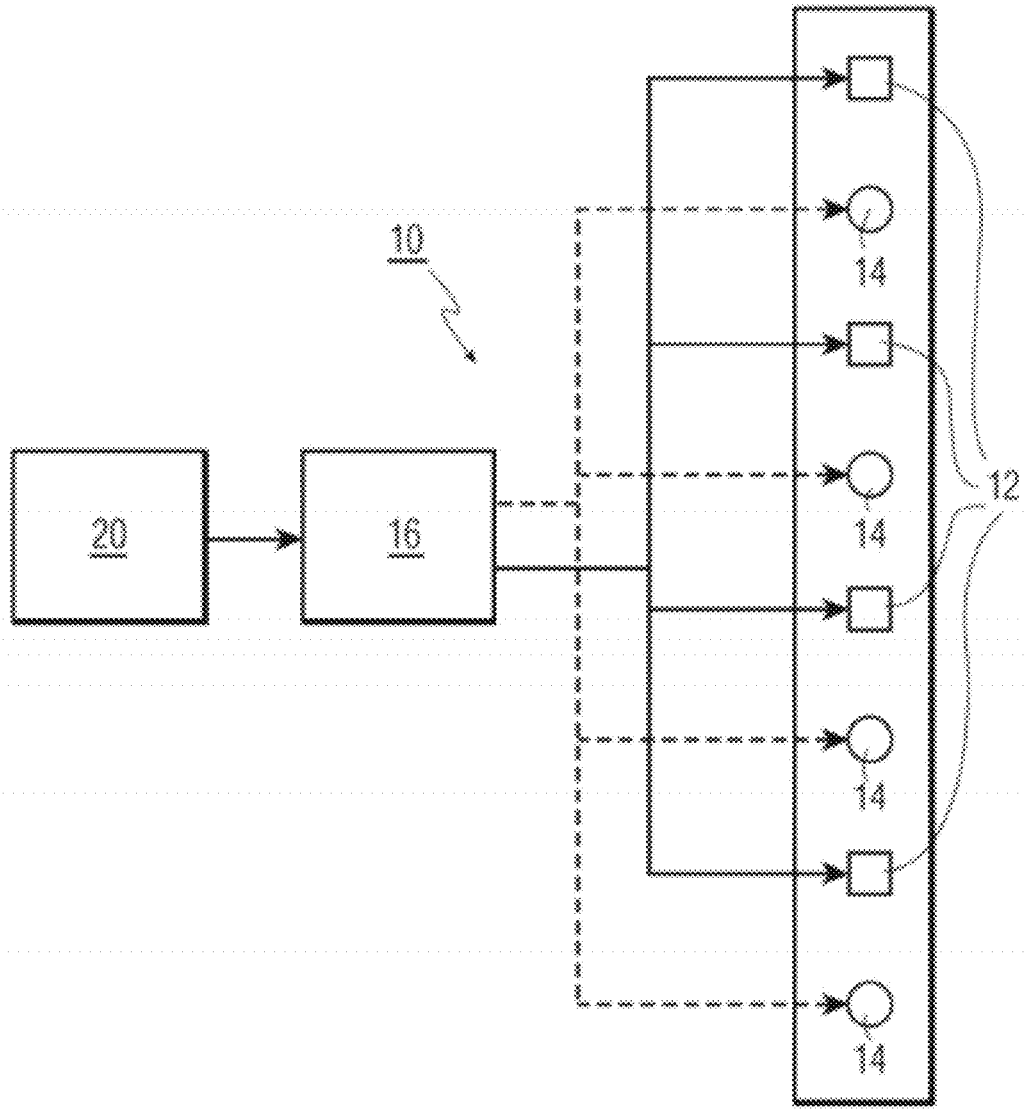
FIG. 1 shows a diagrammatic view, partially in block form, of an LED lighting system in accordance with the invention, with a first type of LEDs being diagrammatically shown as squares and a second type of LEDs being diagrammatically shown as circles.

FIG. 1 shows a preferred form of the invention, in which a lighting system 10 includes a first type 12 of LED and a second type 14 of LED to create an LED lighting system that uses the advantages of both types of LEDs. Preferably, the second type of LED has a substantially higher efficacy than the first type 14 of LED, preferably by at least about any of the following percentages: 10, 20, 25, and 50 percent. As a typical example, the first type 12 of LED is a warm white LED, and the second type 14 of LED is a cool white LED. Alternatively, the first and second types 12 and 14 of LEDs could be colored LEDs, such as red and green LEDs respectively.

At least 70 percent (and preferably all) of the first type 12 of LED is controllable together in a first control group of LEDs: and at least 70 percent (and preferably all) of the second type 14 of LED is controllable together in a second group of LEDs. Either of the first type 12 or second type 14 of control groups may have only a single LED. Control system 16 controls each of the first and second control groups of LEDs.

The first and second types 12 and 14 of LEDs may be physically separate from each other, but may be mounted to the same substrate (not shown). Each LED may have its own optic (not shown) for directing light to an area to be illuminated. In one alternative, at least one LED of the first type 12 and at least one LED of the second type 14 use the same optic. Either of the first or second types 12 or 14 of LEDs may be of a different color (e.g., red) from the other type (e.g., white). Further, at least one LED of the first or second types 12 or 14 may have a color temperature that is above, below or on the black body curve. Or, both types 12 and 14 of LEDs may be on, above, or below the black body curve.

Lighting system 10 has one or more modes of operation, including a reduced-power usage mode. Several modes of operation are discussed herein.

Preferably, lighting system 10 maintains the same effective light levels (lumens) from the system in the reduced-power usage mode as the light levels when the first control group of warm white LEDs 12 is operated at full power. This is desirable to keep the light from falling below minimum light levels required in a given space. Alternatively in the reduced-power usage mode, the first control group of LEDs 12 and the second control group of LEDs 14 are independently controlled so that the resulting light levels are at least at a predetermined percentage of the light level when the first control group of the first type 12 of LEDs operates at a power level between less-than-full power and full power and the second control group of the second type 14 of LEDs is off. Such predetermined percentage can be 50, 75, 90, 100 or 110, for instance. Setting the predetermined percentage to at least 110 will provide a lumen level in a reduced-power usage mode that is higher than in a normal mode. By "full power" is meant the intended nominal output of the system.

Further alternatively, in the reduced-power usage mode, the light levels are operated at least at a predetermined percentage of the light level when the first control group of the first type 12 of LEDs operates in a normal mode when the space to be illuminated is occupied by a person and the second control group is off. The foregoing predetermined percentages apply here as well. By "normal mode" is meant the mode used for normal illumination purposes, which is not a mode for providing an extra-high amount of light for special situations, etc. Typically, the normal mode is determined by local regulations, which in the U.S. for instance, usually conform to guidelines of the Illumination Engineering Society of North America, and in other localities, conform to guidelines of comparable organizations.

Figure 2:
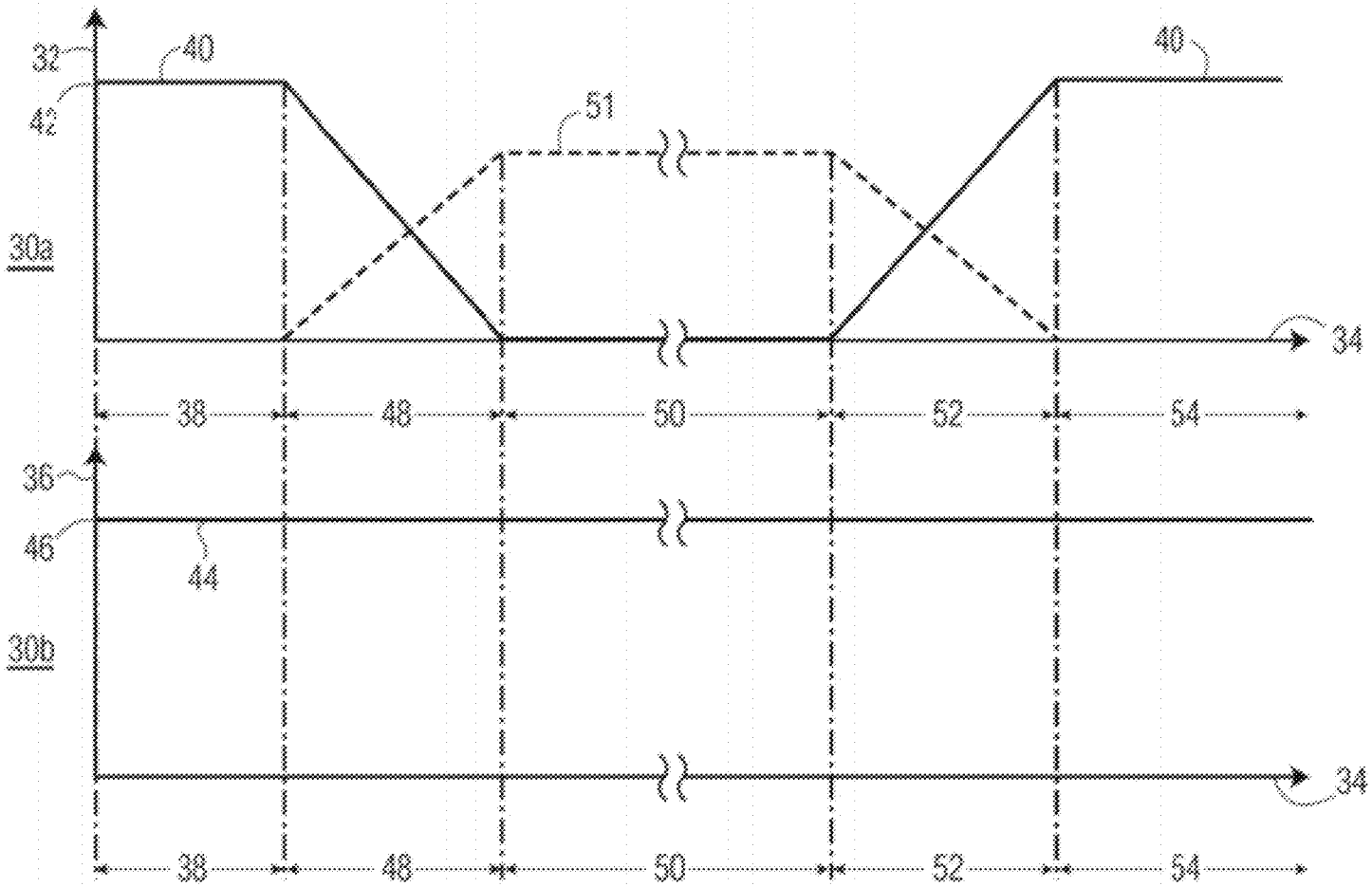
FIG. 2 shows an upper graph illustrating electrical power supplied to a lighting system versus time, and a lower graph illustrating light level (lumens) versus time for the lighting system.

In FIG. 2, the upper graph 30*a* illustrates electrical power 32 supplied to a lighting system 10 (e.g., FIG. 1) versus time 34; and the lower graph illustrates light level (lumens) 36 versus time 34.

In time interval 38, electrical power curve 40 for the first control group of the first type 12 of LEDs is at a preferably normal level 42 (upper graph 30*a*) and light level curve 44 (lower graph 30*b*) is also preferably at a normal level 46. In fact, the light level curve 44 preferably remains at or close to normal level 46 in lower graph 30*b* during the entire time period illustrated.

Ignoring time interval 48 for a moment, the lighting system has entered into a reduced-power usage mode in time interval 50. During interval 50, electrical power level curve 51, shown as a dashed line, for the second control group of the second type 14 of LEDs provides the sole power for the lighting system. Power curve 51 is lower in intensity (height) than power curve 40 for the first control group of the first type 12 of LEDs during preceding interval 38. However, at the same time, as indicated in lower graph 30*b*, in this preferred embodiment, the light level curve 44 remains the same or close to the normal level 46.

Time interval 48, preceding the just-discussed interval 50, shows a preferred gradual transition in powering of the respective first and second control groups of the first type 12 and second type 14 of LEDs. The transition is from operation of the lighting system in a normal mode to operation in the reduced-power usage mode. Preferably, interval 48 is at least one second in duration and is selected to minimize the perceptibility of the transition to an occupant of an area illuminated by the lighting system. Although in interval 48, power level curves 40 and 51 are shown as linear, the characteristics of the LEDs chosen may require curves 40 and 51 to be non-linear so as to result in uniformity of light output during interval 48. Similarly, time interval 52, preceding interval 54 of normal operation of the lighting system, is gradual in the same manner and for the same reasons as just mentioned for time interval 48. Gradual transitioning during intervals 48 and 52 (and all others similar intervals described herein) may be replaced by relatively abrupt transitions of power; however, there would then likely be some transient changes in light level, which may be undesirable or distracting to occupants.

Control system 16 (FIG. 1) decreases the overall power consumption of lighting system 10 by turning off or dimming the first control group of first type 12 of LEDs and turning on the second control group of the second type 14 of LEDs to at least some extent. FIG. 2 illustrates the procedure of turning off the first group of first type LEDs 12 and turning on the second control group of the second type 14 of LEDs.

Communications from Command System to Control System

Figure 3A:
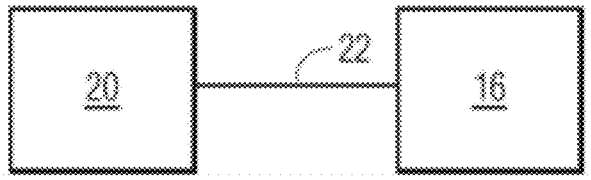
FIGS. 3A and 3B show diagrammatic views, partially in block form, of a command system and a control system and interconnections between them.
Figure 3B:
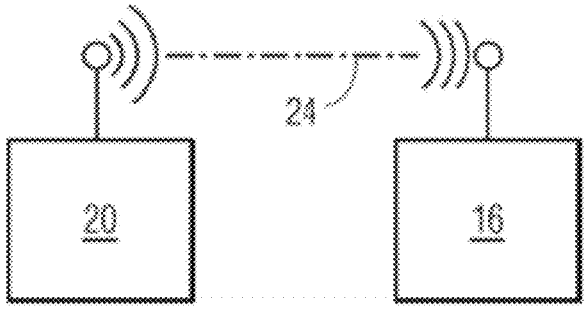
Figure 4:
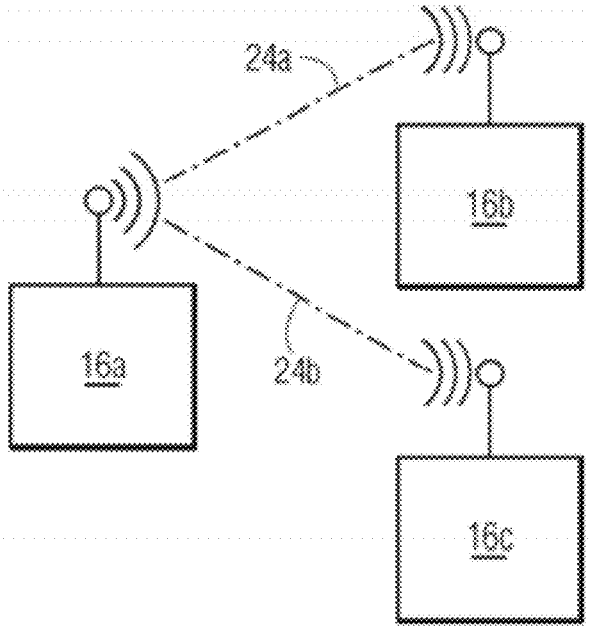
FIG. 4 shows a diagrammatic view, partially in block form, of a master-slave arrangement of control systems for various LED lighting systems.

As shown in FIGS. 3A and 3B, communications from the command system 20 to the control system 16 may occur by over a wire link 22 or a wireless link 24, such as one using a ZigBee protocol. Preferably, command system 20 for many lighting systems 10 is situated in a single location in a building. In this connection, as shown in FIG. 4, one control system 16*a* may receive signals from a command system 20 (e.g., FIG. 3B) and, acting as a master control system, communicate over wireless (or wired) links 24*a* and 24*b* with control systems 16*b* and 16*c*, acting as slave control systems for respective lighting systems (not shown). In this way, for instance, a single command system 20 need only communicate with master control systems, which simplifies communications.

Other means of communicating from command system 20 to control system 16 include power line communication within a building, dedicated hard lines within a building, or a central building controller which can manipulate either electricity or lighting control for the entire building. Other means of input (not shown) include a text message, email, fax or telephone call providing a series of dial tones to the system. Autonomous function is also feasible where the fixture is under internal control.

Reasons to Change to Reduced-Power Usage Mode

In a preferred embodiment, when electricity is priced at a normal (or typical) level, lighting system 10 operates with only the first control group of the first type 12 of warm white LEDs, at a higher power and lower efficiency in relation to the second control group of the second type 14 of cool white LEDs. However, the warm white output from the first type 12 of LEDs have a correlated color temperature (CCT or "color temperature") that is usually more desired by the end-user than the cool white from the second type 14 of LEDs. When electricity demand is rising, or at a peak, and the price of electricity is at a premium, preferably the lighting system 10 switches from a normal mode of operation with only the first type 12 of LEDs and operates at the less desirable, higher color temperature, such as by using the second type 14 of LEDs that produces cool white light, but that uses less energy. Preferably, the light output will not drop below the levels mentioned In the foregoing paragraph when operating with the warmer LEDs.

The foregoing change from a normal mode of operation of lighting system 10 to a reduced-power usage mode is an optional change, that is, to reduce operating cost. Other reasons to make this optional change of mode include simply a desire to be more energy efficient, etc. Various entities—governmental, private or individual—may be inclined to initiate a lower power consumption mode by sending signals to users who have opted to receive such signals.

For instance, government agencies that have an interest in power consumption by the public include the Department of the Interior, National Science Foundation (NSF), Environmental Protection Agency (EPA), Department of Energy (DOE), Department of Defense (DOD), National Weather Center and Emergency Broadcast Network. For instance, the DOD can send out a signal to decrease power consumption when electricity is needed. Without such a signal, there may be a blackout and any long-term war goals may not be met. Another sector with an interest in communicating signals on power consumption levels includes private companies, private environmental groups, electricity brokers and more. Varied individuals can send signals to control power consumption levels.

Multiple Inputs to Control System

Inputs to the control system 16 may be implemented in several ways. Inputs can be manual, contemporaneous or request entry for a reduced-power usage mode for a future time or times. An input may be contemporaneous when a directive is sent to change into reduced-power usage mode immediately. An input requesting a change to the reduced-power usage mode at a future time or times can also be preferably accommodated.

Figure 5:
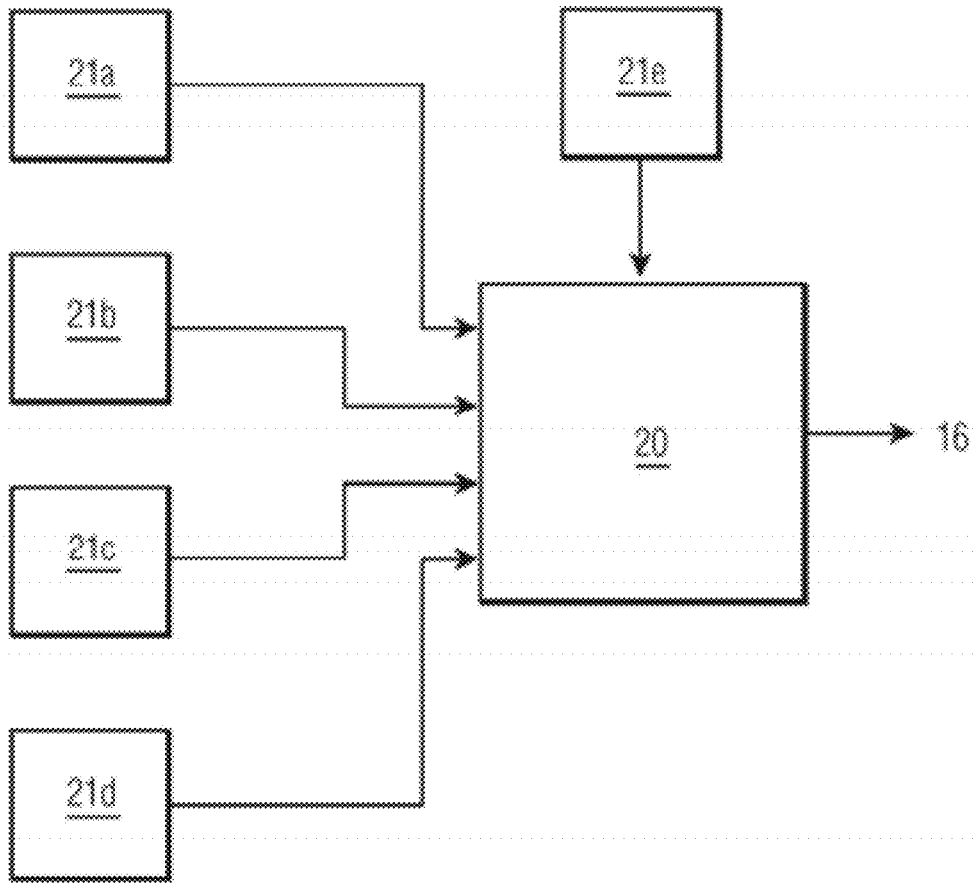
FIG. 5 shows a block diagram representation of a control system having different inputs for receiving different types of instructions.

FIG. 5 shows multiple inputs to command system 20 (FIG. 1), which in turn sends commands to control system 16 (FIG. 1). Illustrative inputs 21*a*-21*e* respectively comprise:

A manual input 21*a* such as a mechanical switch;

Future-scheduling input 21*b*, which is preferably used for receiving information of future times for entering into a reduced-power usage mode and so can be pre-programmed by command system 20, a contemporaneous request input 21*c*, which is preferably used when a request for immediate changeover from a normal mode, for instance, to a reduced-power mode is requested, an occupancy sensor input 21*d*, which desirably causes changeover from a normal mode, for instance, to a reduced-power usage mode when the space to be illuminated is free of occupants, and a manual override switch 21*e*, if desired, which gives manual switch 21*a* priority over any or all of inputs 21*b*-21*d*.

With regard to the future-scheduling mode, if the times for reducing power usage are forecast in advance and received by future-scheduling input 21*b* (FIG. 5), command system 20 preferably automatically schedules a change in mode of the lighting system 10 from a normal mode of operation, for instance, to a reduced-power usage mode during such times. Pre-programming can rely, for timing purposes, on mechanical timers which are individually-controlled or centrally-controlled. Alternatively, by way of example, pre-programming can rely, for timing purposes, on the atomic time clock from the National Institute of Standards and Technology (NIST) radio station WWV located in Fort Collins, Colorado, U.S.A., which commonly broadcasts information such as geophysical alerts and marine storm warnings.

Automating Change to Reduced-Power Usage Mode

For ease of operation to avoid paying a high cost for power when the cost temporarily rises sharply, for instance, it is desirable for the lighting system to receive signals, as defined above, from an entity supplying, controlling or monitoring electrical power for the lighting system and automatically initiate the reduced-power usage mode. This can be accomplished from a command system 20 which is receptive to signals from the foregoing power-supply entity, for determining when to initiate and when to terminate the reduced-power usage mode. Entities supplying, controlling or monitoring power include, but are not limited to, national and regional power grid monitors, individual utilities, utility groups, distribution centers and networks, substations, the Advanced Meter Infrastructure (AMI), Demand Response Automation Servers (DRAS), Energy Management Control Systems (EMCS) and any part of a current power grid or future smart power grid.

Power companies can send signals concerning price of electrical power to a user based on different pricing plans or programs.

Dimming Feature

In cases where the lighting in a space to be illuminated is above the minimum levels, and therefore can be dimmed to minimum levels and reduce power, the claimed system has further benefits over either compact fluorescent lamps (CFLs) or other fluorescent lamps. As LEDs are dimmed they do not decrease in efficiency as do CFLs and other fluorescent lamps. In fact, the opposite is true and, as LED power is decreased, their efficacy actually increases. So, in the case where light levels are usually kept above a minimum level, the first control group 12 warm white LEDs can be dimmed down until the minimum light levels are reached and then the operation can switch to the second control group 14 of cool white LEDs if further power reduction is required. This sequence of events is illustrated in FIG. 6.

Figure 6:
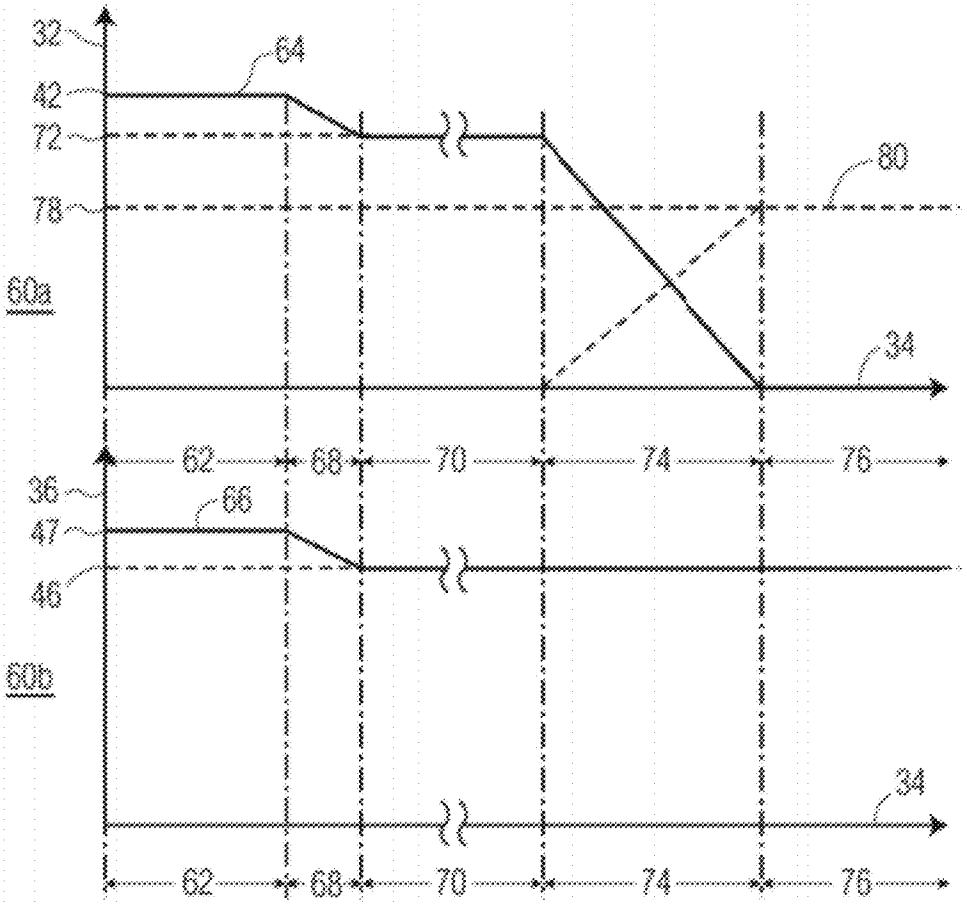
FIG. 6 shows an upper graph illustrating electrical power supplied to a lighting system versus time, and a lower graph illustrating light level (lumens) versus time for the lighting system.

In FIG. 6, the upper graph 60*a* illustrates electrical power 32 supplied to a lighting system 10 (e.g., FIG. 1) versus time 34; and the lower graph illustrates light level (lumens) 36 versus time 34.

In time interval 62, electrical power curve 64 for the first control group of the first type 12 of LEDs is at an above-minimum normal level 42 (upper graph 60*a*) and light level curve 66 (lower graph 60*b*) is at an above-minimum normal level 47. However, ignoring time interval 68 for a moment, during subsequent time interval 70, power curve 64 drops to a first reduced level 72, and light level curve 66 also drops to a minimum level 46.

Time interval 68, preceding interval 70 of normal operation of the lighting system, is gradual in the same manner and for the same reasons as mentioned above for time interval 48 in FIG. 2.

What is notable in FIG. 6 is the change in light level in lower graph 60*b* from an above-minimum normal level 47 to a minimum level 46, followed by maintaining approximately the same lighting level 46. This occurs, although the power level of the lighting system drops from a first-reduced power level 72 to a second-reduced power level 78. It is noted that only during the second-reduced power level 78 (upper curve 60*a*) does the lighting system draw power from the second control group of second type 14 LEDs, as indicated by dashed-line power curve 80.

Occupancy Sensor Mode

Additionally the lighting system described herein can use an occupancy sensor for initiating a reduced-power usage mode. One type of occupancy sensor is a type of motion detector integrated with a timing device. When an electronic sensor detects that motion has stopped for a specified time period, a signal is sent to occupancy sensor input 21*c* (FIG. 5) of command system 20, for initiating a reduced-power usage mode as described above, such as that of FIG. 2, which is described above.

Other Modes of Operation

In addition to the reduced-power usage mode described herein, the lighting system beneficially can have other modes of operation. For instance, both warm white LEDs and cool white LEDs can be operated at the same time and in varying proportions for various reasons. As a result, any color temperature between the two types of LEDs can be reached by varying the power to each type of LED. If an abundance of light is required for any reason, then both types of LEDs can be turned on up to their maximum levels, to preferably double the light output from the system without having to install additional light sources.

As will be apparent to those of ordinary skill in the art, command system 20 (FIG. 1) may comprise a simple mechanical switch, or various other devices such as for interpreting signals (e.g., text messages, emails, phone calls with touch tone signaling) from a supplier of electrical power. Further, control system 16 may comprise microprocessor and other conventional control circuitry. Construction of such aspects of the invention will be routine to those of ordinary skill in the art based on the present specification.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. An LED lighting system having a reduced-power usage mode, comprising:

a) first and second types of LEDs collectively mounted on a lighting fixture; the second type of LED having a substantially higher efficacy than the first type of LED by at least about 10 percent;

b) at least 70 percent of the first type of LED being controllable together in a first control group of LEDs by a control system;

c) at least 70 percent of the second type of LED being controllable together in a second control group of LEDs by said control system;

d) said control system independently controlling only the first and second control groups of LEDs in said lighting fixture; said control system having one or more modes including a reduced-power usage mode for decreasing the overall power consumption of the lighting system while maintaining a light level of at least a predetermined percentage of the level present when the first control group of LEDs operates at a power level between less-than-full power and full power and the second control group is off, said predetermined percentage being 50; and e) the control system decreasing the overall power consumption of the lighting system in the reduced-power usage mode by turning off or dimming the first control group and turning on the second control group to at least some extent.

2. The LED lighting system of claim 1, wherein the predetermined percentage is about 90.

3. The LED lighting system of claim 1, wherein the predetermined percentage is about 75.

4. The LED lighting system of claim 1, wherein the predetermined percentage is about 100.

5. The LED lighting system of claim 1, wherein the predetermined percentage is about 110.

6. The LED lighting system of claim 1, wherein the turning on of the second control group occurs gradually over a period of time of at least one second.

7. The LED lighting system of claim 1, wherein, during the reduced-power usage mode, the control system turns off the first control group and turns on the second control group.

8. The LED lighting system of claim 7, wherein the turning off of the first control group and the turning on of the second control group by the control system each respectively occur gradually over a period of time of at least one second.

9. The LED lighting system of claim 1, wherein the control system is responsive to remote control signals for initiating and terminating the reduced-power usage mode.

10. The LED lighting system of claim 1, further comprising a command system for receiving signals from a governmental, private or individual entity supplying, controlling or monitoring power for the lighting system, and in response to said signals, automatically instructing the control system to initiate the reduced-power usage mode contemporaneously or at a scheduled time.

11. The LED lighting system of claim 1, further comprising a command system for receiving a signal from an occupancy sensor; the command system, in turn, instructing the control system to enter into the reduced-power usage mode.

12. The LED lighting system of claim 11, wherein the means to control the first and second control groups comprises means to dim the first control group of LEDs.

13. The LED lighting system of claim 11, wherein the means to control the first and second control groups comprises means to turn off the first group of LEDs.

14. The LED lighting system of claim 1, wherein the first type of LED provides a substantially warmer color temperature than the second type of LED by a color temperature difference of at least about 500 K.

15. The LED lighting system of claim 14, wherein:

a) the color temperature of the first type of LED is between about 2500 K and about 6500 K; and b) the color temperature of the second type of LED is between about 3000 K and 7000 K.

16. The LED lighting system of claim 1, wherein the lighting system comprises only said first and second types of LEDs.

* * * * *